US008076559B2

(12) United States Patent
Toone

(10) Patent No.: US 8,076,559 B2
(45) Date of Patent: Dec. 13, 2011

(54) INTONATION CANTILEVER

(76) Inventor: Richard Warren Toone, Milford, NJ (US)

( * ) Notice: Subject to any disclaimer, the term of this patent is extended or adjusted under 35 U.S.C. 154(b) by 0 days.

(21) Appl. No.: 12/660,597

(22) Filed: Mar. 2, 2010

(65) Prior Publication Data

US 2011/0067548 A1 Mar. 24, 2011

Related U.S. Application Data

(60) Provisional application No. 61/277,002, filed on Sep. 18, 2009.

(51) Int. Cl.
*G10D 3/04* (2006.01)

(52) U.S. Cl. ..... 84/298; 84/299; 84/312 R

(58) Field of Classification Search ..... 84/298, 84/299, 312 R
See application file for complete search history.

(56) References Cited

U.S. PATENT DOCUMENTS

| | | | | | |
|---|---|---|---|---|---|
| 615,053 | A | * | 11/1898 | Utt | 84/299 |
| 4,031,799 | A | * | 6/1977 | Fender | 84/307 |
| 4,236,433 | A | * | 12/1980 | Holland | 84/726 |
| 4,248,126 | A | * | 2/1981 | Lieber | 84/299 |
| D261,527 | S | * | 10/1981 | Carson | D17/21 |
| 4,361,068 | A | * | 11/1982 | Schaller | 84/299 |
| 4,385,543 | A | * | 5/1983 | Shaw et al. | 84/298 |
| 4,453,443 | A | * | 6/1984 | Smith | 84/298 |
| 4,541,320 | A | * | 9/1985 | Sciuto | 84/298 |
| 4,611,523 | A | * | 9/1986 | McFarland | 84/313 |
| 4,632,005 | A | * | 12/1986 | Steinberger | 84/313 |
| 4,867,031 | A | * | 9/1989 | Fender | 84/313 |
| 5,355,759 | A | * | 10/1994 | Hoshino | 84/298 |
| 5,448,935 | A | * | 9/1995 | Kosinar | 84/298 |
| 5,600,078 | A | * | 2/1997 | Edwards | 84/307 |
| 5,939,653 | A | * | 8/1999 | Chang | 84/313 |
| 6,031,165 | A | * | 2/2000 | Brekke | 84/298 |
| 6,124,536 | A | * | 9/2000 | Hoshino | 84/298 |
| 6,133,515 | A | * | 10/2000 | Hoshino | 84/307 |
| 6,297,434 | B1 | * | 10/2001 | Martello | 84/298 |
| 6,465,722 | B2 | * | 10/2002 | Powers | 84/298 |
| 6,710,235 | B2 | * | 3/2004 | Hirayama | 84/313 |
| 6,806,411 | B1 | | 10/2004 | Allen | |
| 6,867,354 | B2 | * | 3/2005 | Shimooka et al. | 84/312 R |
| 6,875,910 | B2 | * | 4/2005 | Naimish | 84/298 |
| 7,179,975 | B2 | * | 2/2007 | Feiten et al. | 84/312 R |
| 7,279,626 | B2 | * | 10/2007 | Draper et al. | 84/298 |
| 7,326,839 | B2 | * | 2/2008 | Kinoshita | 84/298 |
| 7,327,109 | B1 | | 2/2008 | Hagen | |
| 7,563,968 | B2 | * | 7/2009 | Medas | 84/298 |
| 7,566,823 | B1 | | 7/2009 | Niskansen | |
| 7,589,267 | B1 | | 9/2009 | Sims | |
| 7,592,528 | B2 | | 9/2009 | Lyles et al. | |
| 7,598,449 | B2 | | 10/2009 | Sullivan | |
| 7,612,282 | B1 | | 11/2009 | Lawing | |
| 7,638,697 | B2 | * | 12/2009 | Moore | 84/298 |
| 7,838,752 | B2 | * | 11/2010 | LaMarra | 84/313 |
| 7,868,235 | B2 | * | 1/2011 | Medas | 84/298 |
| 2011/0067548 | A1 | * | 3/2011 | Toone | 84/312 R |

* cited by examiner

*Primary Examiner* — Elvin G Enad
*Assistant Examiner* — Robert W Horn

(57) ABSTRACT

An aspect of the system relates to an intonation control mechanism for controlling, for example, the pitch of a plucked or vibrated string of a stringed instrument through a string contact point located at an appropriate intonation harmonic.

20 Claims, 7 Drawing Sheets

INTONATION CANTILEVER

CROSS REFERENCE TO RELATED APPLICATIONS

This application seeks priority to U.S. Provisional Application 61/277,002, filed Sep. 18, 2009, the entirety of which is incorporated by reference.

FIELD OF THE INVENTION

The present invention relates to musical instruments. More specifically, the invention relates to an intonation control mechanism for controlling, for example, the tension, height and position of a plucked or vibrated string of a stringed instrument through a string contact point located at an appropriate intonation harmonic. An additional function of the mechanism is to couple vibration of the strings to the neck and soundboard thereby amplifying both string and soundboard movement.

BACKGROUND INFORMATION

Conventional technologies do not provide adequate intonation control for the vibrating strings of a stringed instrument, causing compromised tuning throughout the fingerboard, e.g, tempered tuning. Traditionally, strings are attached to a support at the top of the neck—defined as "head" or "headstock"—of the instrument from which strings travel down the neck to a top fret, conventionally defined as a "nut" where the fret has individual cut slots (grooves) within fret. This fret is an immovable support that provides friction capture of the string as the string travels down the neck of the instrument to a bridge and pickup system. These conventional technologies are easy to manufacture, but provide no variability for the musician.

Conventional technologies at the head of the instrument are further deficient in that these technologies do not provide for adequate adjustability of string position relative to the fingerboard, or adjacent strings, as well as lateral, tangential or longitudinal string tension on the instrument. Conventional technologies provide a single fixed point, i.e. "nut" which requires irreparable physical alteration by a skilled technician with specialized tools in order to make string spacing, gauge or height changes. Such limited adjustability does not provide for intonation control and adjustability. Intonation is defined as a realization of pitch accuracy by the musician, whereby such accuracy is dependent upon ultimate string position, tension and the ability of the musician to accurately play the instrument at a desired position. In conventional technologies, the dimensions of the cut slot determines friction capabilities of the "nut" in holding the string to the instrument. These "nut" designs are made of premolded plastic, metal, or bone components that wear through friction over time. Thus, the wearing of the nut causes the instrument to lose intonation as well as altered string position relative to the fingerboard or adjacent strings. Temperature and humidity are important additional variables affecting intonation of an instrument. Conventional instruments remain highly dependent upon these variables due to the fixed point friction design. As a variable changes, the tune and intonation of the instrument changes, requiring the musician to frequently retune the instrument or have it repaired.

There is a need to provide an intonation control mechanism that allows strings to be independently adjusted for string position relative to the fingerboard, and adjacent strings, as well as lateral, tangential or longitudinal string tension on the instrument and ultimately instrument intonation without requiring disassembly, relocation or irreparable physical modification of the mounting structure to the stringed instrument.

There is a further need to provide a mechanism that will allow for pitch control of a vibrating string in a stringed instrument and to couple the vibration of the string to the soundboard as well as to the neck.

There is a further need to provide an instrument that has a mechanism that minimizes the amount of time an individual will spend tuning the instrument.

SUMMARY OF THE INVENTION

It is therefore an objective of the invention to provide an intonation mechanism to control pitch and couple string vibration to the soundboard of a stringed musical instrument yet dissociate—or greatly reduce in comparison to conventional technologies—primary (direct) string vibration from the mounting structure of the bridge, e.g., intonation cantilever.

It is a further objective of an aspect of the invention to provide an intonation mechanism to simply alter the relationship between string and fingerboard, thus affecting playability (force required to fret a note at a given pitch) pitch, and intonation, without requiring interactive adjustments to the soundboard, soundboard bracing, or neck (fingerboard) angle in relation to the soundboard or bridge, e.g., intonation cantilever. This will facilitate and simplify tuning, maintenance, repair, and playability adjustments.

It is also an objective of an aspect of the invention to provide an intonation control mechanism that allows strings to be independently adjusted for string height (above the fingerboard), spacing (distance between strings) and intonation (pitch) without requiring disassembly or relocation of the mounting (holding) structure, e.g., intonation cantilever. This will facilitate and simplify construction, maintenance, repair and playability adjustments; including of multi-scale instruments, e.g, fanned fret (multi-scale).

It is a further objective of an aspect of the invention to provide an intonation control mechanism that allows strings to be independently adjusted for string height (above the fingerboard), spacing (distance between strings) and intonation (pitch) without requiring disassembly or relocation of the mounting (holding) structure, and for this mechanism to be located at either the neck or body end of the strings, e.g., intonation cantilever. This will facilitate and simplify construction, maintenance, repair and playability adjustments; including of multi-scale instruments, e.g, fanned fret (multi-scale).

It is a further objective of an aspect of the invention to provide an intonation mechanism to facilitate location independent of the primary mass of the structure of the bridge, e.g. intonation cantilever. The intonation mechanism can dissociate from structural necessity, i.e., function independently of form, shape, size, configuration, integrity and design issues related to the primary mass of the structure of the bridge, as well as of the soundboard. This will dissociate—or greatly reduce, in comparison to conventional technologies—bridge mass from the soundboard, thus increasing the directional vibrational responsiveness of the soundboard and enhancing transient detail, overtone, and note articulation amplification. This will also facilitate soundboard designs that require less structural bracing, thus simplifying construction, maintenance, and reducing mechanical failure opportunities.

It is a further objective of an aspect of the invention to provide an intonation control mechanism to facilitate location independent of other strings, and in relation to the intonation length of the string, e.g., intonation cantilever. This will simplify design, construction, and playability adjustments; including of multi-scale instruments, e.g, fanned fret systems.

It is a further objective of an aspect of the invention to provide an intonation mechanism to redirect longitudinal string tension and increase contact force between the string and intonation point (saddle), e.g., intonation cantilever. This will enhance vibration coupling between the string and intonation point (saddle).

It is a further objective of an aspect of the invention to provide an intonation mechanism to redirect longitudinal string tension and increase contact force between the string and intonation point (saddle) with greatly reduced—in comparison to conventional technologies—reciprocal force applied to the soundboard, e.g., intonation cantilever. This will reduce soundboard damping, thus increasing the directional vibrational responsiveness of the soundboard and enhancing transient detail, overtone, and note articulation amplification.

It is a further objective of an aspect of the invention to provide an intonation mechanism to facilitate string self-alignment—longitudinal, tangential, lateral—in relation to the nut, saddle, bridge, and tuning mechanism, e.g., intonation cantilever. This will reduce friction and string breakage.

It is a further objective of an aspect of the invention to provide an intonation mechanism to facilitate longitudinal, tangential and lateral string movement, e.g., intonation cantilever. This will reduce friction and string breakage, and facilitate and simplify tuning.

It is a further objective of an aspect of the invention to provide an intonation mechanism that facilitates string vibration and reduces damping, thus enhancing transient detail, overtone, and note articulation amplification, e.g., intonation cantilever.

It is a further objective of an aspect of the invention to provide an intonation mechanism to facilitate anchoring of the string, without the necessity of a ball-end or anchoring device integral to the string. This will facilitate use of conventional, commercially available, nonproprietary strings.

The objectives of the invention are achieved as illustrated and described. In an embodiment of the invention, a plain or ball-end string is anchored to an intonation cantilever mounted in the nut position of the neck or the bridge position of the body. In an alternate embodiment of the invention, the string contacts an intonation point (saddle) and anchors independently of the intonation cantilever. In an alternate embodiment of the invention, the intonation cantilever is a supported beam. The intonation cantilever is adjustable for string height (above the fingerboard), spacing (distance between strings) and intonation (pitch) without requiring disassembly or relocation of the mounting (holding) structure. In an alternate embodiment of the invention, the string contacts an intonation point (saddle) coupled to a piston that contacts the soundboard. The piston slides freely in the intonation cantilever transferring vibration from intonation point (saddle) to soundboard, or the piston can held in position (clamped) to the intonation cantilever. In an alternate embodiment of the invention, the string passes through a string alignment guide. In an alternate embodiment of the invention, more than one intonation cantilever is located on one mounting plate. These objectives are accomplished without coupling primary (direct) string vibration to the mounting structure of the bridge.

DETAILED DESCRIPTION

Referring to all embodiments provided in FIGS. 1A, 1B, 1C and 1D, 1E and 1F, a view of an intonation cantilever arrangement 5 is illustrated. The intonation cantilever 5 allows a musician to change and specify the intonation for a musical instrument. The intonation cantilever 5 is a fully adjustable unit that may fit, for example, at the head of an instrument. For the purposes of this description, the head of the instrument is defined as the extreme end of the guitar furthest away from the body of the guitar.

In the illustrated embodiments provided, the intonation cantilever 5 is made of a material that is rugged to allow the cantilever 5 to be capable of holding a string of a stringed instrument without significant bending, warping or need for servicing. Such materials may be, as non-limiting examples, aluminum, steel, brass, copper, metallic alloys, sturdy plastics and epoxy materials, or wood. In the illustrated embodiment, the intonation cantilever 5 is made of aircraft grade aluminum to allow the entire cantilever to be light weight, yet strong.

The mounting of the intonation cantilever 5 is accomplished through a connection established on the head of the instrument. The connection in the illustrated embodiment is a mounting screw 2. The mounting screw 2 can be configured with any threading necessary to provide proper connection to the head of the instrument. The head of the mounting screw 2 may be a standard flat head connection, Torx head, Allen head or Phillips head design, as non-limiting examples. The head of the mounting screw 2 may directly contact a mounting surface of the intonation cantilever 5 to evenly distribute the force from the intonation cantilever 5 to the contact surface at the head of the instrument. The mounting screw 2 may be configured of the same metal or material as the intonation cantilever 5 to prevent galvanic corrosion from occurring.

Although illustrated as a single mounting screw 2 that attaches the intonation cantilever 5 to the instrument, other configurations are possible and the arrangement shown should be considered non-limiting. In an alternate configuration, the intonation cantilever 5 may be attached through a chemical bond to the head of the instrument. In another non-limiting embodiment, the intonation cantilever 5 may be attached to the head of the instrument by a series of locking slides placed in the headstock of the instrument. In this embodiment, the intonation cantilever 5 may be slid onto the headstock of the instrument and placed into proper position by a series of locks that prevent further movement of the cantilever 5 when placed into correct position.

Figure 1A:
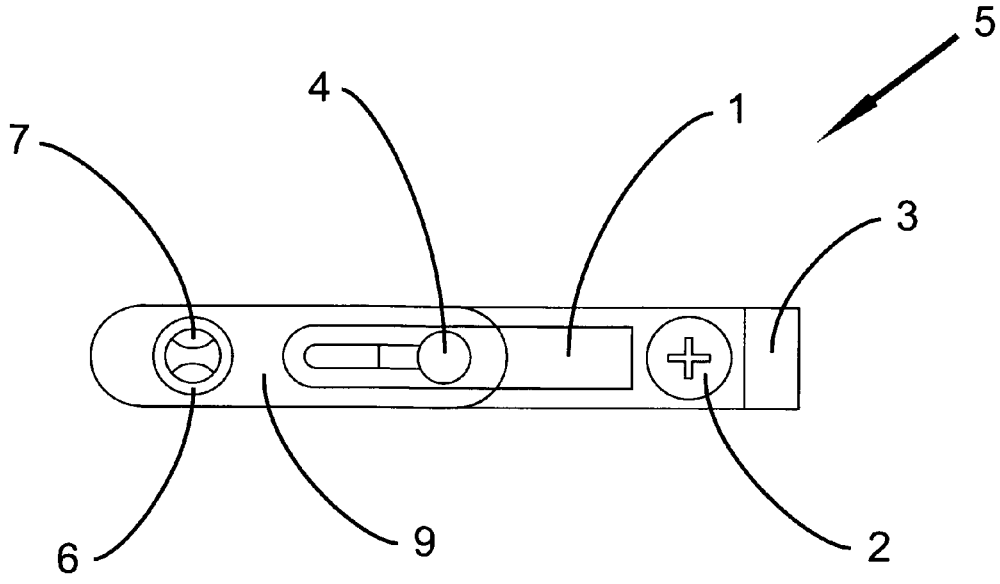
FIG. 1A is an expanded top view of the intonation cantilever in conformance with an embodiment of the invention.
Figure 1B:
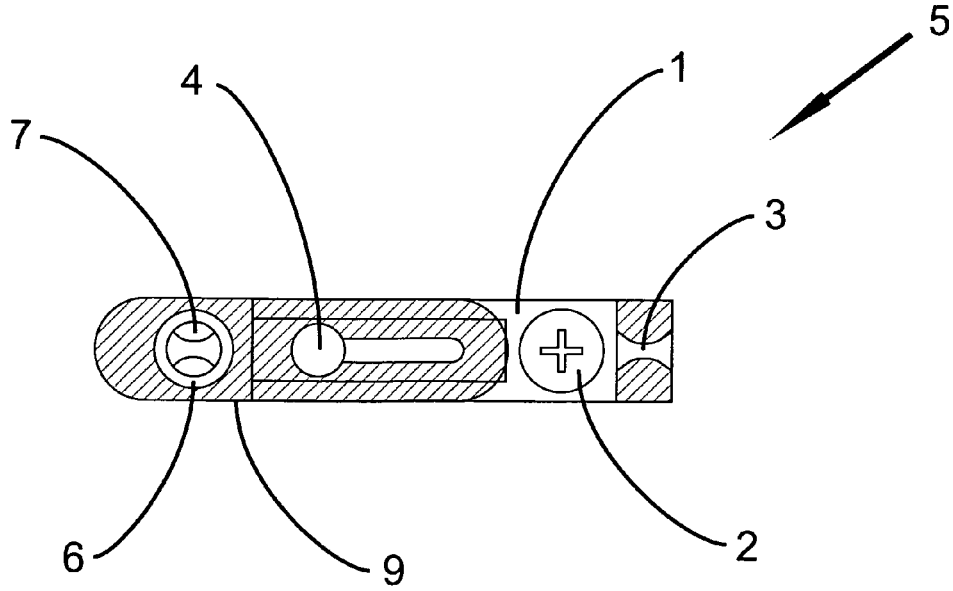
FIG. 1B is a contracted top view of the intonation cantilever in conformance with the embodiment of FIG. 1A.

In the illustrated embodiment provided in FIG. 1A, the intonation cantilever 5 is positioned in an "expanded" state, wherein an adjustment screw 4 is arranged to let the slide portion 9 of the intonation cantilever 5 be positioned in the "expanded" position. Referring to FIG. 1B, a top view of the intonation cantilever 5 is illustrated, wherein the cantilever 5 is placed in a contracted state through the slide portion 9 being slid toward the mounting screw 2 and secured in place by the adjustment screw 4. The adjustment screw 4 connects the slide portion 9 of the intonation cantilever 5 to the mounting plate 1 that abuts the headstock of the stringed instrument.

The adjustment screw 4 connects the mounting plate 1 to the slide portion 9. The mounting plate 1 is drilled to accept the threads of the adjustment screw 4 so that the components may be secured together. In the illustrated embodiment, the adjustment screw 4 is configured with a large number of threads per unit length of travel, allowing fine adjustment between the slide portion 9 and the mounting plate 1. The adjustment screw 4, in the illustrated embodiment, is made of the same material as both the mounting plate 1 and the slide portion 9 to eliminate potential galvanic corrosion. The head of the adjustment screw 4 may be a standard flat head screw top, Torx head, Allen head or Phillips head design, as non-limiting examples. The head of the adjustment screw 4 may directly contact a specially created mounting surface to evenly distribute the force from the slide portion 9 to the mounting plate 1.

Referring to FIGS. 1A and 1B, a piston 6 is placed in the slide portion 9 of the intonation cantilever 5. The piston 6 is created to provide an intonation point 7, (in this non-limiting example defined as a slotted frustoconical unit through a screw), that inserts into the piston 6. Other types of screws and geometries may be used. The string of the stringed instrument passes through the frustoconical intonation point 7. The piston 6 rises a predefined height to allow the musician to define the overall height of the string as it passes along the neck of the instrument. In the illustrated embodiment, the piston 6 is a press fit, non-rattling unit that fits within the slide portion 9 of the intonation cantilever 5. In the illustrated embodiment of a frustoconical intonation point screw 7, the screw 7 may be inserted or removed, through the screw threads, from the piston 6 to a desired height defined by the musician. In this manner, the musician may preselect the overall height of the string of the instrument.

Figure 1C:
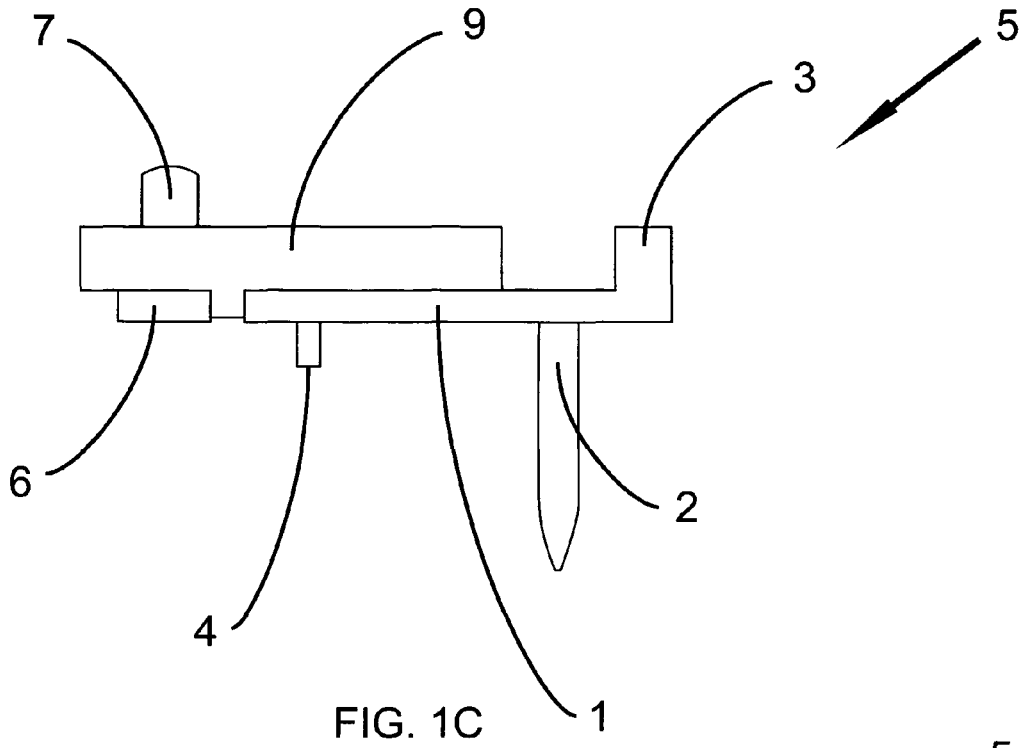
FIG. 1C is a contracted side view of the intonation cantilever in conformance with the embodiment of FIG. 1A.
Figure 1D:
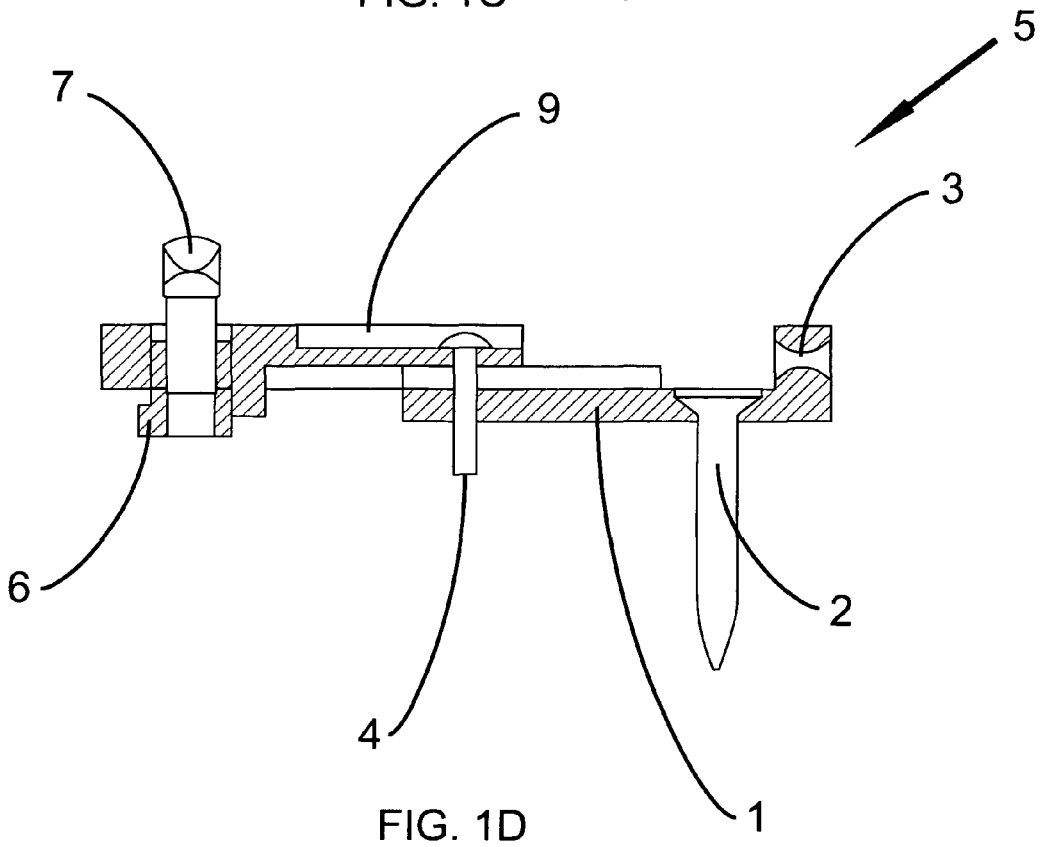
FIG. 1D is an expanded sectional view of the intonation cantilever in conformance with the embodiment of FIG. 1A.

Referring to side view FIG. 1C and sectional view FIG. 1D, the adjustment screw 4 may be configured with sufficient length such that the adjustment screw 4 may penetrate a countersunk hole in the neck of the stringed instrument. This attachment between the screw 4 and the neck of the stringed instrument may allow for resistance to turning of the intonation cantilever 5 as two points of attachment will be created. Although illustrated as a flat bottomed screw, the adjustment screw 4 may also be configured with a point to successfully insert into the neck of the instrument. In another configuration, the neck of the stringed instrument may be configured with an insertable sleeve to allow the adjustment screw 4 to be captured by the neck of the instrument.

Figure 1E:
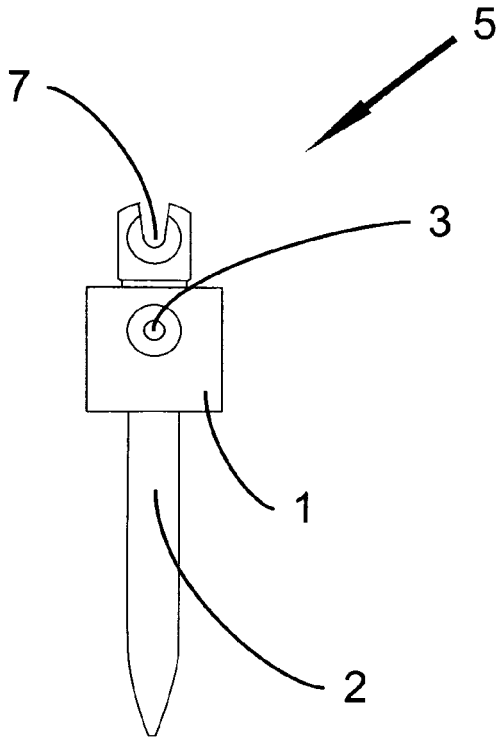
FIG. 1E is an alternate end view of the intonation cantilever in conformance with the embodiment of FIG. 1A.
Figure 1F:
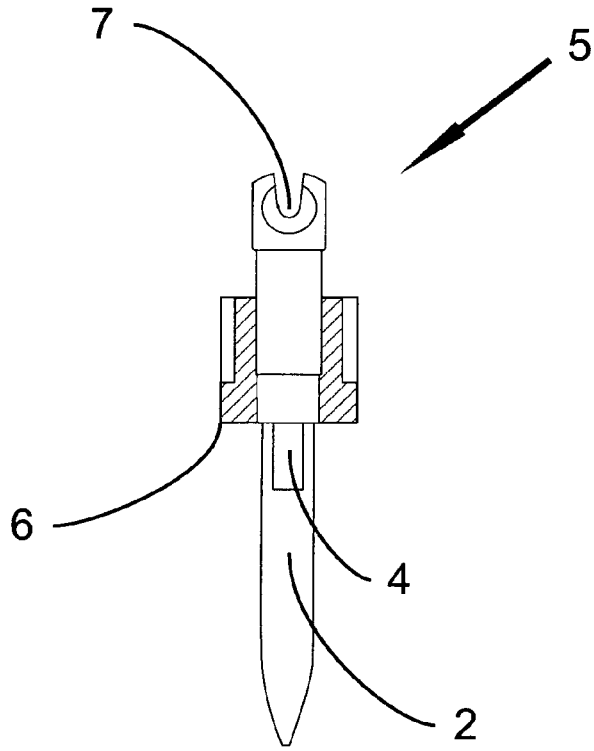
FIG. 1F is a sectional end view of the embodiment of FIG. 1E.

FIG. 1E illustrates a side view of the intonation cantilever 5 of FIG. 1A. FIG. 1F illustrates a sectional side view of the intonation cantilever 5 of FIG. 1A.

The string for the stringed instrument enters through a string guide 3, as illustrated in FIGS. 1A, 1B, 1C, and 1D. The string guide 3 is non-binding positional device that allows for the string to be guided to the frustoconical intonation point screw 7. The string guide 3 does not provide any sharp edges though which the string may bind.

Figure 2A:
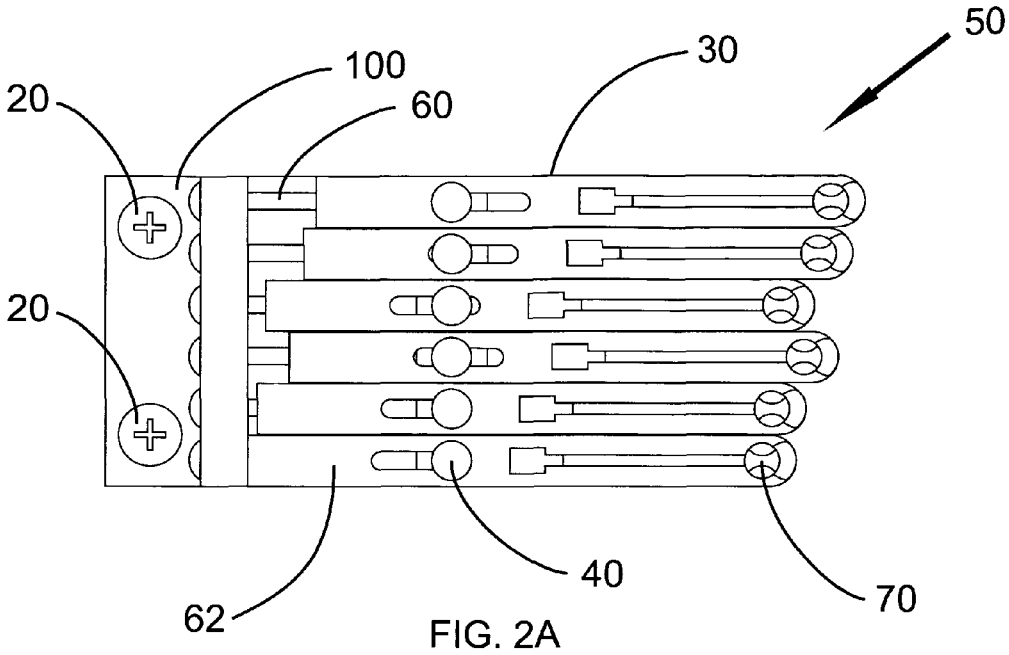
FIG. 2A is a top view of a second embodiment of the intonation cantilever in conformance with an embodiment of the invention.
Figure 2B:
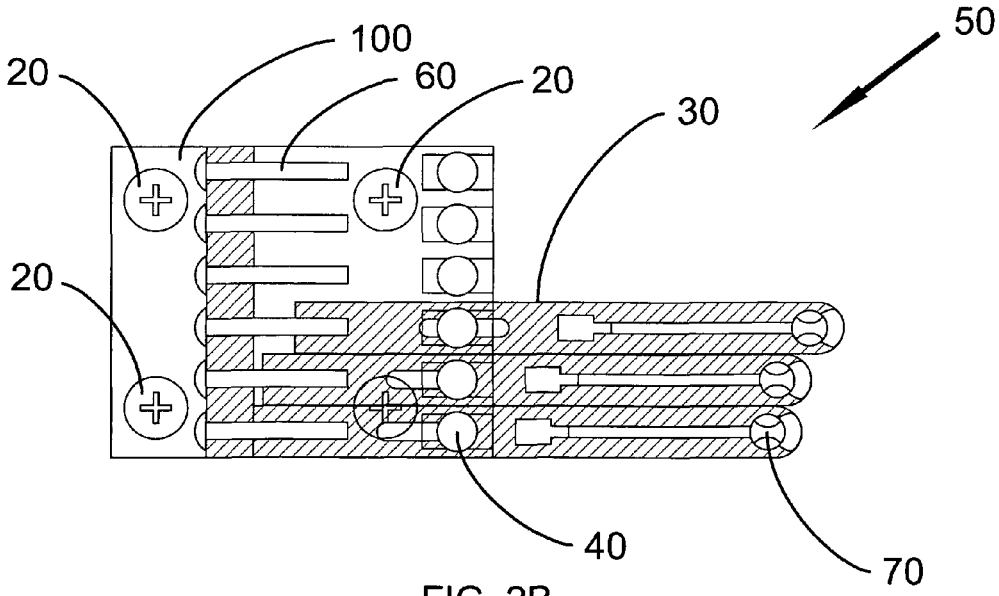
FIG. 2B is a top exploded view of the second embodiment with components removed for clarity of the intonation cantilever in conformance with the embodiment of FIG. 2A.
Figure 2C:
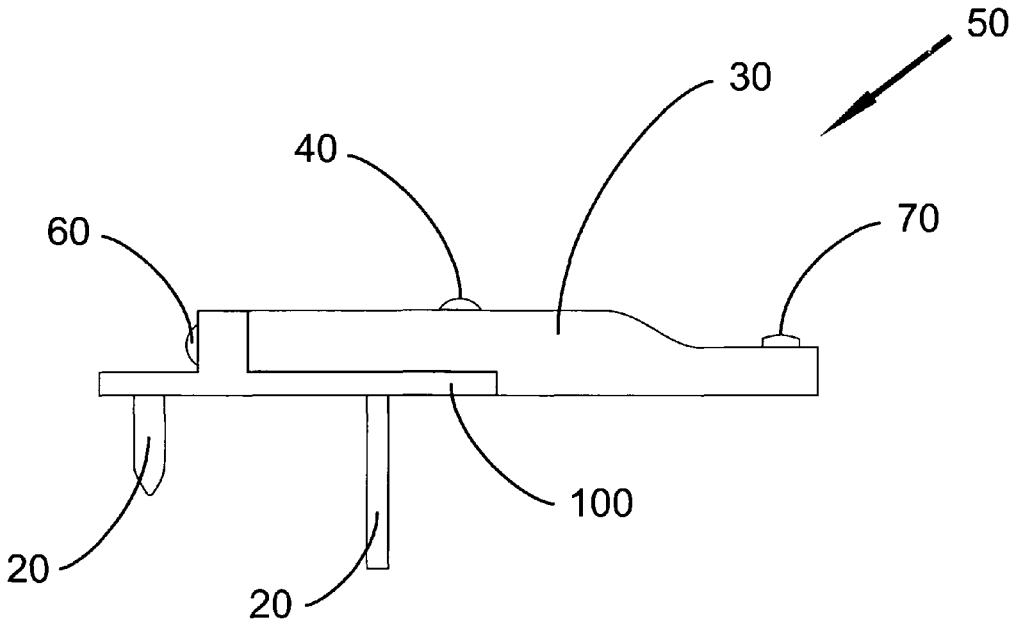
FIG. 2C is a contracted side view of the intonation cantilever in conformance with the embodiment of FIG. 2A.
Figure 2D:
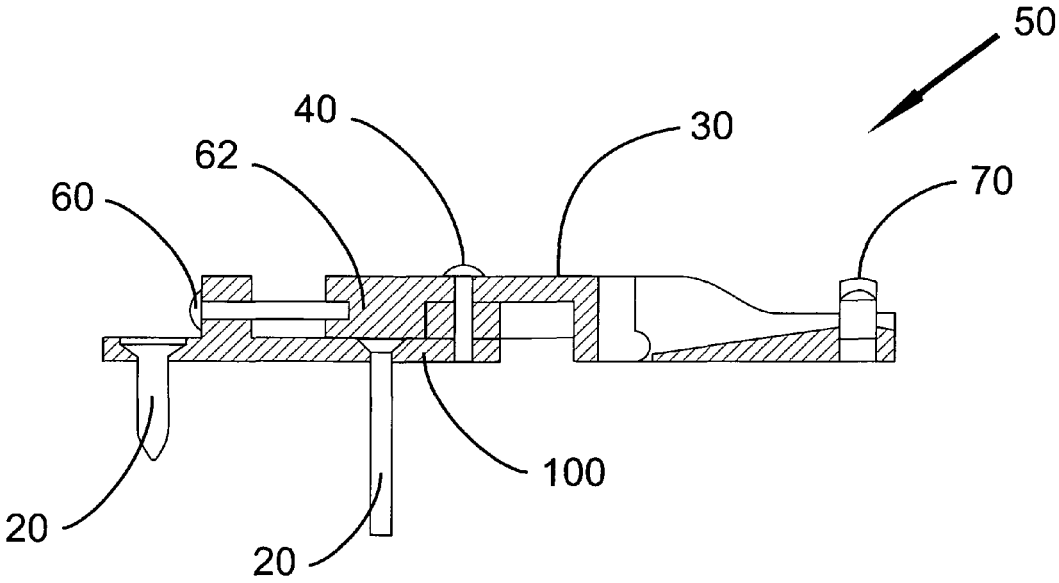
FIG. 2D is an expanded sectional side view of the intonation cantilever in conformance with the embodiment of FIG. 2A.

Referring to FIGS. 2A through 2F, a second embodiment of the intonation cantilever 50 is illustrated. FIG. 2C is a side view of the arrangement, while FIG. 2D is a sectional side view. In this embodiment, mounting screws 20 are used to position the remainder of the intonation cantilever 50 on to the neck of a stringed instrument. The head of the mounting screws 20 may directly contact a mounting surface of the intonation cantilever 50 to evenly distribute the force from the intonation cantilever 50 to the contact surface at the head of the instrument. The mounting screws 20 may be configured of the same metal or material as the intonation cantilever 50 to prevent galvanic corrosion from occurring.

Adjustment screws 40 attach the slide portion 30 to the baseplate portion 100. Lateral tension screws 60 are positioned to connect the baseplate portion 100 of the intonation cantilever 50 to the slide portion 30. The slide portion 30 has a drilled and tapped portion 62 that accepts the lateral tension screws 60 to provide lateral tension between the slide portion 30 and the baseplate portion 100. The lateral tension screws 60 may also provide longitudinal string tension adjustment.

Figure 2E:
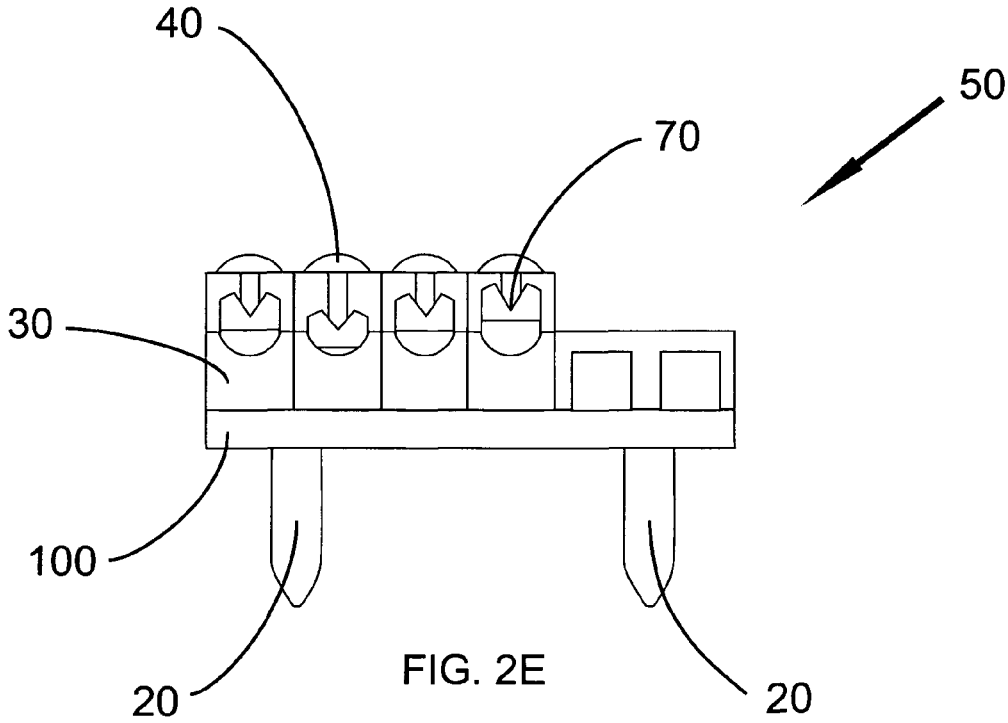
FIG. 2E is a side end view of the intonation cantilever in conformance with the embodiment of FIG. 2A.
Figure 2F:
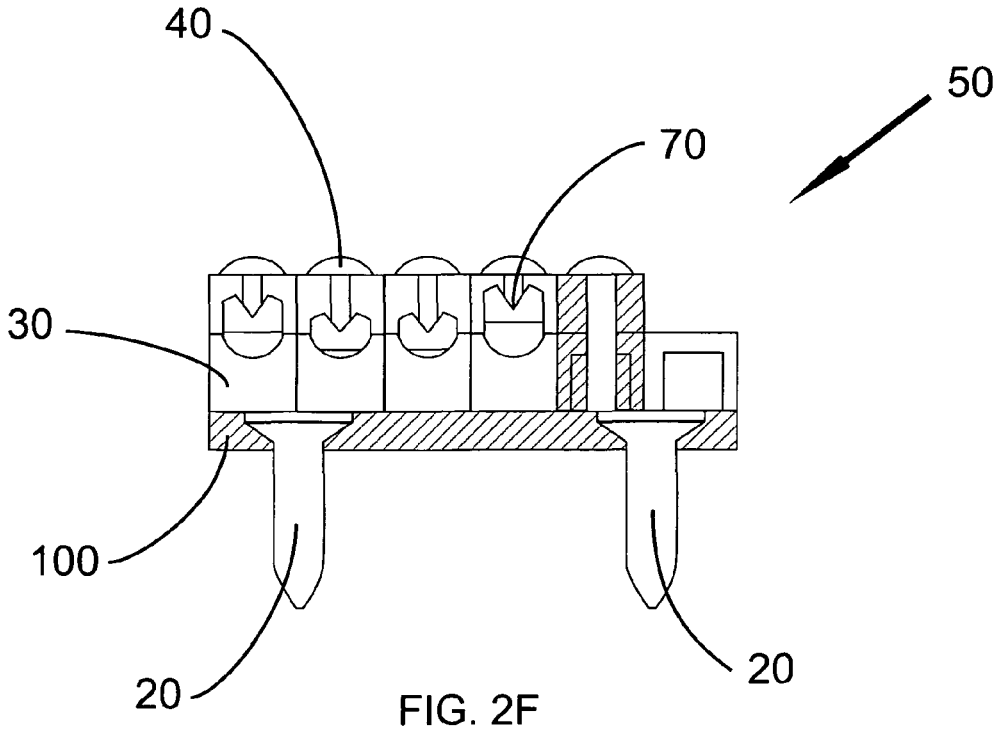
FIG. 2F is an alternate end sectional side view of the intonation cantilever in conformance with the embodiment of FIG. 2A.
Figure 3:
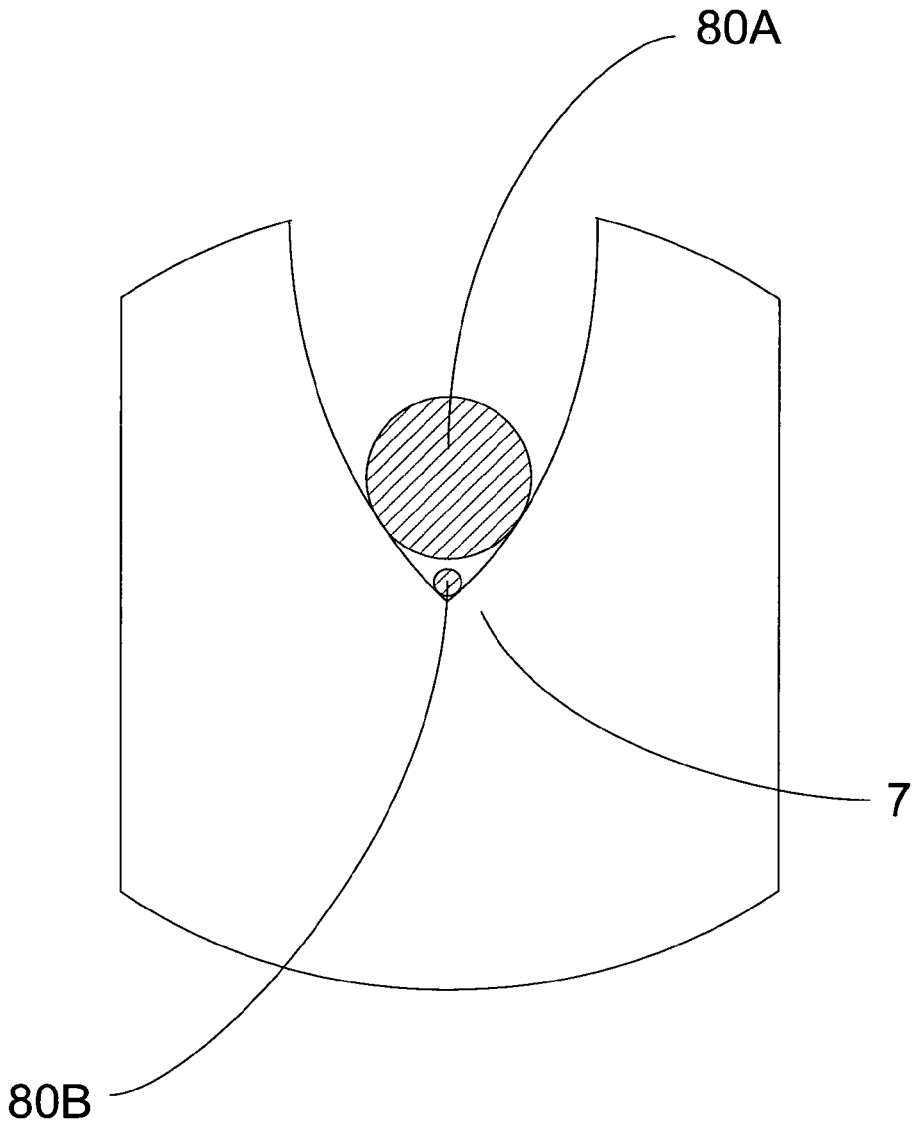
FIG. 3 is an end view of an intonation point (saddle) in conformance with an embodiment of the invention.

Referring to FIGS. 2E and 2F, an intonation point (saddle) 70, that may have various geometries such as an advantageous frustoconical unit, is provided to accept a string, that may, as illustrated in FIG. 3, vary in size. The string may range in size from a 0.008" diameter string, as in 80A to a 0.080 diameter string as in 80B, as non-limiting examples. String diameter may include any commercially available string diameter for fretted or fretless hand held stringed instruments, including: guitar, bass, violin, cello, mandolin, and banjo as non-limiting embodiments. In FIG. 2E, two of the slide portions 30 are removed for clarity of view of the baseplate 100. In FIG. 2F, one slide portion 30 is removed, and one slide portion 30 is illustrated in sectional view for clarity of view of adjustment screw 40 and baseplate 100. In FIG. 2C, the intonation point (saddle) 70 is retracted into the body of the slide portion 30. In FIG. 2D, the intonation point (saddle) 70 is expanded from the slide portion 30. In all FIG. 2 embodiments, a vertical screw 40 also may be used to attach the slide portion 30 to the baseplate portion 100.

The string, as it passes through the intonation point (saddle) 70 is supported to allow the string to pass through the remainder of the intonation cantilever 50, thus the saddle 70 guides the string at a desired height.

The intonation point (saddle) 70 is height adjustable, in this illustrated embodiment, through an embedded piston that provides a predefined amount of force upon the string. In an alternative configuration, the frusto conical intonation point (saddle) 70 may be a manually adjustable screw or height adjustable wedge. In the illustrated embodiment, the piston may be a gas operated unit, or, as provided, a spring with a fixed spring constant. As illustrated in FIG. 2E, each of the saddles 70 may be individually height adjustable according to the needs of the musician.

The aspects of the invention provide several advantages over conventional technologies. First, conventional technologies only provide for what is conventionally called a "nut". The "nut" only provides an elongated bar or top fret, with accompanying grooves, that a string passes through on the string's progression down the neck of the stringed instrument to the bridge design. The "nut" design, while cheap to manufacture, has several different drawbacks that minimize usefulness. This design requires the use of expensive and complicated bridge mechanisms down near the center or bottom of the instrument to allow for adjustments of string tension and string height. Thus, conventional designs never address any type of variability at the head of the instrument, but rather take a simplistic approach of simply guiding the string over a slotted fret. This conventional design does not allow for any variability of the string performance whatsoever other than providing for a string attachment point to the instrument.

Aspects of the current invention, however, allow a musician to independently vary different parameters of individual strings at the head of the instrument before they progress down the neck of the instrument. Thus, on its face, aspects of the invention eliminate the non-variability of the conventional head type designs. The complete failure of such conventional systems to allow for readily changeable string height, position and intonation of the instrument are solved by the current invention.

The use of aspects of the current invention at the head of the instrument can eliminate expensive bridge and pickup systems used on stringed instruments, thereby saving on the overall cost of the stringed instrument.

Aspects of the current invention also allow for the use of either proprietary or non-proprietary strings in the instrument, thereby allowing a musician to choose the string more appropriate to his/her preference.

Aspects of the current invention also provide for a compact design at the head of the instrument, allowing for light weight operation with full adjustability not found in conventional designs. The compact design is ruggedly constructed so that string position, tension and intonation specific parameters are maintained during movement. The compact design also provides a robust locking mechanism for the string, allowing the instrument to maintain its desired tune and performance characteristics over time. As is well known by people of skill in the art, conventional systems are required to be tuned regularly before they are played. These conventional systems thereby are variable to the point that excessive time is spent by the musician to fine tune the instrument back to a desired play configuration. Aspects of the current invention remove the variables presented by conventional systems, thereby allowing a musician to simply pick up the instrument and play, without need for excessive tuning. This solves the long sought need of musicians worldwide, eliminating tuning mechanisms and wasted valuable play time.

In an alternative embodiment, aspects of the invention also provide for a more efficient coupling of string vibration and soundboard when the invention is provided at a base of the stringed instrument rather than at the head of the instrument. When located at the base or middle of the instrument, the vibration from the string may be more accurately coupled to the soundboard through the design of the invention. This accurate coupling of the invention to the soundboard allows for a more harmonious sound of the instrument compared to conventional systems.

In an alternate embodiment of the invention, the intonation cantilever may be an adjustable ramp assembly. This assembly may be split into at least two ramps—wedges—that allows for intonation point adjustment. In an alternate embodiment of the invention, the intonation cantilever may be hinged. In non-limiting examples, the hinge may divide the intonation cantilever and it may be located where the intonation cantilever attaches to the mounting plate. The intonation cantilever serves as a positioning device that allows any simple machine sub-assembly to adjust the intonation point of the at least one string.

What is claimed:

1. An intonation cantilever for a stringed instrument, comprising:

a mounting plate with at least one hole an elongate slide portion with an adjustment screw connecting the elongate slide portion to the mounting plate through at least one hole in the elongate slide portion, the elongate slide portion configured to extend along at least a part of a length of at least one string between a first position to a second cantilevered extended intonation position with respect to the mounting plate; and at least one attachment configuration to connect the mounting plate to at least one of a body, a soundboard, and a neck of the stringed instrument.

2. The intonation cantilever according to claim 1, wherein the mounting plate has at least one hole; and at least one attachment configured to connect the cantilever to the stringed instrument, the at least one attachment established through the at least one hole in the mounting plate.

3. The intonation cantilever according to claim 1, wherein the intonation cantilever is made of at least one of a metal, a plastic, and a wooden material.

4. The intonation cantilever according to claim 1, wherein the mounting plate configured with a string guide to accept and guide the at least one string.

5. The intonation cantilever according to claim 4, wherein the string guide is height adjustable.

6. The intonation cantilever according to claim 4, wherein the string guide is at a distal end to an end closest to the adjustment screw.

7. The intonation cantilever according to claim 1, further comprising;

a piston press fit into the elongate slide portion.

8. The intonation cantilever according to claim 1, wherein the adjustment screw penetrates through the elongate slide portion and the mounting plate.

9. The intonation cantilever according to claim 1, further comprising:

a piston configured through the elongate slide portion.

10. The intonation cantilever according to claim 1, wherein the at least one hole in the mounting plate is a slot and the elongate slide portion is connected to the mounting plate with the adjustment screw through the slot in the mounting plate and the hole in the elongate slide portion.

11. The intonation cantilever according to claim 1, further comprising:

at least one of an adjustable ramp assembly, a split wedge assembly, and a hinge attached to the at least one elongate slide portion.

12. An intonation cantilever for a stringed instrument, comprising:

at least one adjustment screw;

at least one baseplate portion;

at least one slide portion connected to the at least one baseplate portion, wherein the adjustment screw extends through the slide portion into the baseplate portion and the slide portion configured to extend between a first position to a second cantilevered extended position with respect to the at least one baseplate portion, the slide portion having at least one saddle to engage a string of the stringed instrument;

at least one lateral tension screw connecting the baseplate portion to the slide portion; and at least one connection connecting the at least one baseplate portion to the stringed instrument.

13. The-intonation cantilever according to claim 12, wherein at least four slide portions are connected to the at least one baseplate portion.

14. The intonation cantilever according to claim 12, wherein the at least one connection is four screws engaging the at least one baseplate portion and at least one of a body, a soundboard, and a neck of the stringed instrument.

15. The intonation cantilever according to claim 12, wherein the at least one saddle is height adjustable.

16. The intonation cantilever according to claim 12, wherein the intonation cantilever is constructed of at least one of a metal, a wood, and a plastic material.

17. The intonation cantilever according to claim 12, further comprising:

at least one of an adjustable ramp assembly, a split wedge assembly, and a hinge attached to the at least one slide portion.

18. The intonation cantilever according to claim 9, wherein the piston is at a distal end to an end closest to the adjustment screw.

19. The intonation cantilever according to claim 12, wherein the at least one saddle to engage the string of the stringed instrument is located at a distal end to an end nearest the adjustment screw.

20. The intonation cantilever according to claim 12, wherein the at least one saddle is configured to create an intonation point cantilevered and extended from the at least one baseplate portion.

* * * * *